US005243819A

United States Patent [19]

Woerner et al.

[11] Patent Number: 5,243,819

[45] Date of Patent: Sep. 14, 1993

[54] EXHAUST GAS CLEANING DEVICE FOR DIESEL ENGINES

[75] Inventors: Siegfried Woerner; Peter Reiser, both of Esslingen; Peter Prinz, Baltmannsweiler, all of Fed. Rep. of Germany

[73] Assignee: J. Eberspacher, Esslingen, Fed. Rep. of Germany

[21] Appl. No.: 850,392

[22] Filed: Mar. 11, 1992

Related U.S. Application Data

[63] Continuation of Ser. No. 449,966, Dec. 12, 1989, abandoned.

[51] Int. Cl.[5] ..... F01N 3/02

[52] U.S. Cl. ..... 60/274; 60/286; 60/297; 60/299; 60/311; 55/466; 55/DIG. 30

[58] Field of Search ..... 60/286, 274, 297, 299, 60/311; 55/466, DIG. 30

[56] References Cited

U.S. PATENT DOCUMENTS

| | | | |
|---|---|---|---|
| 3,993,160 | 11/1976 | Rauch | 181/266 |
| 4,050,903 | 9/1977 | Bailey | 60/299 |
| 4,209,493 | 6/1980 | Olson | 422/180 |
| 4,610,138 | 9/1986 | Shinzawa | 60/286 |
| 4,615,173 | 10/1986 | Usui | 60/286 |

FOREIGN PATENT DOCUMENTS

| | | | |
|---|---|---|---|
| 114696 | 8/1984 | European Pat. Off. . | |
| 150918 | 8/1984 | Japan | 60/297 |
| 169610 | 7/1986 | Japan | 60/297 |

*Primary Examiner*—Douglas Hart
*Attorney, Agent, or Firm*—McGlew and Tuttle

[57] ABSTRACT

An exhaust gas cleaning device for diesel engines has an exhaust gas soot filter (2) with a filter body (6) that is supported in a housing (4) and is regenerated by combustion of the soot when its temperature rises above the middle operating exhaust gas temperature range. A burner (26) is provided, having a combustion air fan (28) whose hot gas side is in flow communication with the exhaust gas soot filter (2), and the filter body (6) is supported in its housing in such a manner that at least a large part of its outer surface is heated externally during operation of the burner (26).

18 Claims, 1 Drawing Sheet

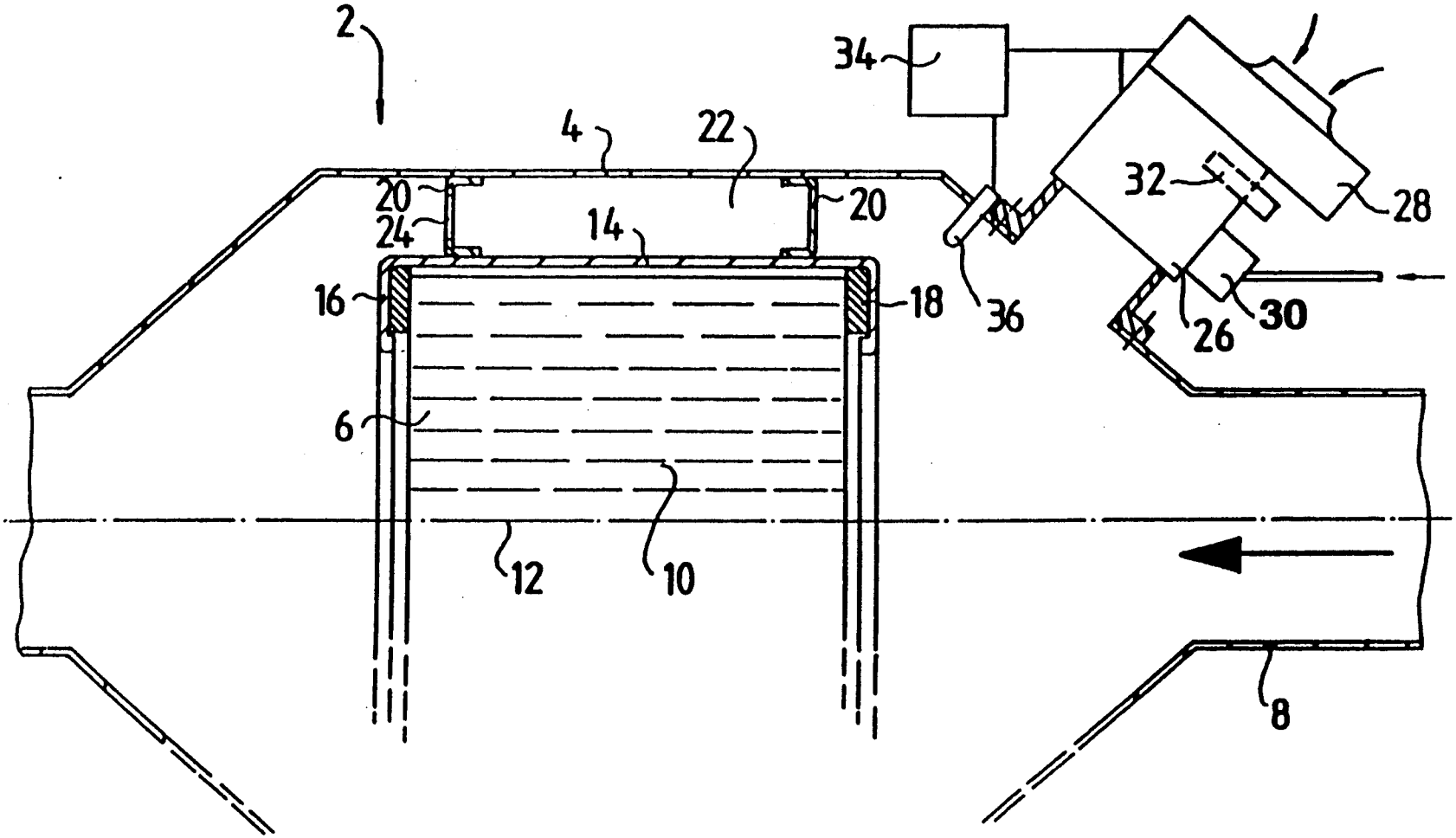
28
30
26
32
36
34
18
20
22
4
14
10
12
20
24
2
16
6
8

EXHAUST GAS CLEANING DEVICE FOR DIESEL ENGINES

This is a continuation application of application Ser. No. 07/449,966 filed Dec. 12, 1989 now abandoned.

FIELD OF THE INVENTION

The invention relates to an exhaust gas cleaning device for diesel engines, comprising an exhaust gas soot filter having a filter body supported in a housing. The filter body being regenerated by combustion of the soot when its temperature rises above the middle operating exhaust gas temperature range.

BACKGROUND OF THE INVENTION

The exhaust gas of diesel engines contains more or less high concentrations of soot particles which are pollutive or even are rated as being a potential hazard to health when present in the breathing air in higher concentrations. This is the reason why endeavors have been made for some time to decontaminate the exhaust gases of diesel engines by removing the soot particles at least to a large extent. As technically most promising measure in the respect, exhaust gas soot filters have been conceived which are designed in their porosity such that they largely retain the soot particles from the exhaust gas flowing therethrough. These soot filters often consist of ceramic material because of the required temperature and strength needed with respect to the usual exhaust gas temperatures of diesel engines. These soot filters also have the tendency of becoming clogged with prolonged time of operation. It was hoped that the soot particles caught in the soot filter would be burnt off virtually to the same extent in which new particles accumulate, and in particular in relation with higher output conditions of the respective diesel engine. However, it has become evident that this hope is not fulfilled at least with a multiplicity of diesel engines. In particular such engines which are not often enough operated in operating conditions with relatively high exhaust gas temperatures. Instead, a constantly increasing accumulation of soot particles in the soot filter takes place which, thus, reaches in increasing manner a condition of undesirably high exhaust gas flow resistance.

SUMMARY AND OBJECTS OF THE PRESENT INVENTION

It is the object of the invention to provide an exhaust gas cleaning device of the type indicated at the outset, which provides more effective regeneration, i.e. more effective soot decomposition, of the exhaust gas soot filter.

For meeting this object it is provided according to the invention that a burner with a combustion air fan is provided whose hot gas side is in flow communication with the exhaust gas soot filter, and that the filter body is supported in its housing such that at least a large part of its outer surface is heated externally during operation of the burner.

Thus, according to the invention care is taken that temperature allowing soot combustion, which are higher than the normal operational exhaust gas temperatures, are present at the soot filter for regeneration thereof, and that the edge portions of the soot filter, which are particularly critical as regards regeneration, are (additionally) heated from the outer surface thereof.

The middle, i.e. operationally normal, exhaust gas temperature range of diesel engines is approximately 200° to 400° C., with temperature peaks during operation in the maximum output range being left unconsidered. The term "outer surface" designates that portion of the outside surface of the soot filter which is not the exhaust gas entry side or the exhaust gas exit side. It may be that, by means of the filter body support according to the invention, almost this entire outer surface of the filter body is heated from the outside. This external heating usually takes place indirectly through a filter body enclosure provided there. The burner usually is in flow communication with the inflow side of the exhaust gas soot filter. By the design of the exhaust gas soot filter according to the invention, a unit having the combined effect of a sound absorber and a soot filter can be made available.

Exhaust gas soot filters often have a substantially prismatic configuration with an exhaust gas entry side and an exhaust gas exit side and a cross-section, transversely of the exhaust gas flow direction, of circular, elliptical, oval, rectangular, square or the like configuration. The term "prismatic configuration" is to cover also such geometries in which the exhaust gas entry side and/or the exhaust gas exit side are not at right angles to the direction of flow through the soot filter and/or in which the outer (circumferential) surface of the soot filter varies progressively within certain limits in the direction of flow therethrough.

For supporting the filter body in the housing of the exhaust gas soot filter, especially with the aforementioned geometries, there are quite a number of possibilities which, according to the invention, permit heating of the outer surface or outer circumference, however care has to be taken in this respect that a flow of the exhaust gases externally past the filter body is to be avoided at least preferably, for ensuring the effective separation of the soot particles from the entire exhaust gas stream. For instance, it would be possible to support the filter body by strut-like supporting parts in its housing in circumferentially spaced manner, and to provide at one location a flow-preventing barrier in the annular gap between the filter body and the housing. Especially preferred is the support of the filter body by means of several ring-like holders which are spaced in the direction of flow and which have perforations in such a number and size that gas can flow therethrough, however, one thereof being closed so as to prevent the afore-mentioned free flow of exhaust gas around the annular gap. It is to be noted that the terms "ring-like" and "annular gap" by no means are supposed to mean "ring-shaped in circular manner", but are to be understood in their comprehensive sense and comprise in particular also oval, elliptical and angular configurations which as a whole are closed in ring-like or annular manner.

The exhaust gas cleaning device according to the invention preferably comprises as filter body a ceramic monolith having discontinuous flow channels, as it is known per se. The most frequent configuration resides in that the flow channels extending substantially in the overall flow direction through the filter body are alternatingly closed at the entry side of the filter body and at the exit side of the filter body, so that the exhaust gas entering a flow channel on the entry side cogently must pass through the porous wall of the particular flow channel into one or several adjacent flow channels in order to be able to leave the filter body on the flow exit side.

The burner preferably is a burner composed in accordance with the principle of a vaporizing burner.

In accordance with a particularly preferred embodiment of the invention the burner is provided for regenerative operation in operational pauses of the diesel engine after a longer diesel engine operational phase each. Thus, according to this embodiment, the burner is not constantly kept in operation in order to sufficiently increase the exhaust gas temperature at the entry to the filter body, but rather one prefers intermittent operation in which the soot filter is regenerated within a quite short period of time during a standstill phase of the diesel engine. In this respect, operation of the burner with excess air is favorable in order to have available in the soot filter oxygen for burning the soot deposited there. The embodiment mentioned renders the combustion of soot especially effective since the hot gases of the burner are not mixed with colder diesel engine exhaust gas.

The exhaust gas cleaning device preferably comprises a control means of the burner which at the beginning of the regenerative operation turns on the combustion air fan and a flow plug for igniting the fuel for the burner, additionally turns on a fuel pump of the burner in time-delayed manner, turns off the glow plug after ignition of the burner since the latter now burns on without aid of the glow plug, and, after a certain time, turns off the fuel pump and allows the combustion air fan to still remain in operation for a short or a longer period of time. This control means controls the said phases of the regenerative operation preferably automatically.

Preferably, a sensor is provided which directly or indirectly detects the amount of clogging of the filter body with soot and which either delivers a signal that new regeneration is necessary, and/or which suitably triggers regeneration on its own, preferably during the next standstill of the diesel engine. The sensor, for instance, can be responsive to the pressure increase in front of the soot filter caused by increased clogging, can operate on the basis of the measurement of gas flow velocities, or the like. It is also possible to employ a device for determining the operating time of the diesel engine since the last regeneration.

The burner preferably is designed such that it brings the filter body to a regeneration temperature of more than 500° C., most preferably of more than 600° C. or even more than 700° C. The burner need not be in operation for the entire regeneration period, since the once ignited soot still burns down also without the aid from the burner and since heat is released in doing so. The burner, furthermore, is preferably designed such that a relatively short regeneration time of some minutes to approx. thirty minutes, depending on the size of the filter body, is sufficient. During combustion of the soot, temperatures in the range of 850° C. may occur.

Preferably, a burner and a combustion air fan for the burner are used as they are already commercially available, especially with respect to motor vehicle heating devices that are independent of the engine.

A particularly preferred field of use of the exhaust gas cleaning device according to the invention are vehicles, in particular fork lifters, which are used in at least largely closed buildings, such as for instance fabrication shops, storehouses or the like. In case of such conditions of use, the exhaust of soot is particularly annoying, and regeneration can be carried out in convenient manner for instance at the end of a shift.

The features of some of the dependent claims, are of inventive significance also without the particular dependence of the claim or in combination with only part of the features of superior claims.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

The invention and further developments thereof will now be elucidated in more detail by way of a preferred embodiment shown in the drawing. The sole drawing shows a longitudinal sectional view of an exhaust gas soot filter and a burner connected thereto.

DETAILED DESCRIPTION OF THE PREFERRED EMBODIMENTS

The exhaust gas soot filter 2 consists essentially of a housing 4 of sheet steel having a ceramic monolithic filter body 6 supported therein. The housing 4 is cylindrical in its central portion and conically tapers on its left-hand and right-hand sides to the diameter of an exhaust gas line 8. The exhaust gas flow direction through the soot filter 2 in the drawing is from right to left, as indicated by arrow P. The exhaust gas line section incoming from the right-hand side comes from a diesel engine and the exhaust gas line section outgoing to the left-hand side leads to the end of the exhaust system. The filter body 6 also is cylindrical and has flow channels 10 which extend substantially parallel to the common longitudinal axis 12 of the filter body 6 and the housing 4. The flow channels 10 are closed in alternating manner on the right-hand side and on the left-hand side.

Furthermore, it is possible to see an intermediate carrier 14 of sheet steel which is substantially cylindrical and has flange portions 16 drawn inwardly at the left-hand and right-hand ends thereof. The filter body 6 is held axially between the two flange portions 16 by means of resilient intermediate rings 18 of sufficiently temperature-resistant material. For reasons of thermal expansion, a narrow gap is present in the radial direction between the filter body 6 and the intermediate carrier 14. The intermediate carrier 14 in turn is welded by means of two annular holders 20 to the interior of the cylindrical portion of the housing 4 so that a circular, annular gap 22 is present between the filter body 6 or the intermediate carrier 14 and the housing 4. The annular gap 22 has a radial width of 5 to 20 mm. the two holders 20 are spaced in an axial direction and are each located closer to an axial end of the intermediate carrier 14 than to the center thereof.

The left-hand, i.e. downstream holder 20 as shown in the drawing is provided across the entire circumference thereof with, for instance, circular openings or perforations 24. These perforations would instead also be provided in the right-hand holder 20 in the drawing. It would also be possible to provide in the left-hand holder larger and numerous perforations 24, while the right-hand holder 20 is provided only with few and small perforations, or vice versa, so that a very small amount of exhaust gas can flow through the annular gap 22 from the front to the rear. The annular gap 22 axially between the two holders 20 may also be filled with a sufficiently temperature-resistant insulating material, for instance basalt wool. The soot filter 2 shown in the drawing and described thus far at the same time serves as an exhaust sound absorber, with the annular space 22 constituting a resonance space.

The conical portion of the housing 4 shown on the right-hand side in the drawing, i.e. the portion on the inflow side, has a burner 26 connected thereto which has a combustion air fan 28. In addition thereto it is possible to see a fuel pump 30 for the fuel of the burner 26, which is for instance diesel oil, and a glow plug 32 for igniting the fuel-air mixture formed in the burner. Finally, one can see a control unit 34 for the burner 26 or the unit formed by the burner 26 and the combustion air fan 28.

When the soot filter 6 is clogged with soot particles to a considerable extend especially after operation of the diesel engine for several hours, regeneration of the filter body 6 is carried out preferably in an operational pause of the diesel engine. For doing so, the combustion air fan 28 and the glow plug 32 are first turned on by means of the control unit 34. After approx. 30 to 60 sec. the fuel metering pump 30 is turned on as well, which feeds fuel into the combustion chamber of the burner 26. When combustion has properly started therein, which can be determined by flame monitoring, the glow plug 32 is turned off, and the combustion air fan 28 continues its operation. The combustion operation of the burner goes on, depending on the size of the soot filter 2, for approx. 2 to 10 min., and a temperature in the order of magnitude of 600° to 750° C. is reached at the filter body 6 within this "activation time". The burner 26 can be turned off now since at this temperature combustion of the soot at the filter body 6 has started and continues also without the aid of the burner. The oxygen necessary therefor can either be taken from the exhaust system (which, as is known, still contains residual oxygen in case of diesel engines), or it can be taken in through the combustion air fan 28 and the burner 26. It is also possible to have the combustion air fan 28 continue its operation, for instance also at a lower level. This combustion of soot takes approx. 5 to 30 minutes depending on the size of the soot filter 2, and during this time the temperature at the filter body 6 may still slightly increase due to the soot combustion, or may remain essentially the same or may drop slightly. After the afore-described turning-off of the burner 27 by turning off the fuel metering pump 30, the combustion air fan 28 definitely is still kept in operation for a certain time, for instance 2 to 4 min., so that no more combustible fuel-air mixture is left in the burner 26.

Reference numeral 36 designates a pressure probe in the space in front of the filter body 6. The pressure probe 36 is responsive to increased pressure caused by increasing clogging of the filter body 6 and indicates the necessity of new regeneration and/or automatically triggers such new regeneration via the control unit 34. This regeneration occurs preferably in a subsequent operational pause of the diesel engine.

Due to the perforations 24 in the left-hand holder 20 the hot gases of the burner 26, after flowing through the filter body 6, can enter into the annular gap 22 and also heat the filter body 6 externally by its outer surface or outer circumference. This heating becomes effective through the intermediate carrier 14. This outer circumference heating is essential for bringing especially the marginal portions of the filter body 6, which are hard to heat without the measure described, to a sufficiently high temperature. When more than two spaced holders 20 are provided, all of all but one thereof are provided with perforations 24.

The output of the burner is in the region of 2 to 15 kW, depending on the size of the soot filter 2.

The soot filter 2 may also have several filter bodies 6 in an axially successive arrangement, and in this case it will be sufficient—when an external flow of exhaust gas past all filter bodies is to be excluded—to provide a surrounding exhaust gas flow barrier at only one of the filter bodies.

We claim:

1. An exhaust gas cleaning device for diesel engines, comprising:

a filter housing having an intake opening connected to a diesel engine exhaust line and including a downstream exhaust exit;

a soot particle filter unit positioned within said filter housing;

a filter body having a filter body inlet facing said diesel engine exhaust line and a filter body exit facing said housing exhaust exit;

means defining a resonance space between said filter body and said housing, including first and second support walls connecting said housing and said filter body, said first support wall being upstream of said second support wall, one of said first support wall and said second support wall having openings for communicating a predetermined amount of heated gas to enter said resonance space for transfer of heat between said heated gas and an outer surface of said filter body and for dampening noise in said resonance space as said gas passes through said openings into said resonance space; and a burner with a combustion fan for generating heated gas, said burner being connected to said filter housing for supplying said heated has to an upstream side of said filter.

2. An exhaust gas cleaning device according to claim 1, wherein:

said exhaust gas cleaning device is provided connected to an exhaust system of a fork lift.

3. An exhaust gas cleaning device according to claim 1, further comprising:

an enclosure on said outer surface of said filter body, said resonance space being formed between said housing and said enclosure.

4. An exhaust gas cleaning device according to claim 1, further comprising:

gas-permeable insulating material positioned in said resonance space.

5. An exhaust gas cleaning device according to claim 1, wherein:

said support walls comprise several spaced ring-like holders provided for supporting said filter body in said filter housing, said holders providing said openings.

6. An exhaust gas cleaning device according to claim 1, wherein:

said filter body is a ceramic monolith with discontinuous flow channels.

7. An exhaust gas cleaning device according to claim 1, wherein:

said filter body is of substantially prismatic configuration having a circular cross-section or a cross-section that is rounded in a non-circular manner.

8. An exhaust gas cleaning device according to claim 1, wherein:

said burner is a vaporizing burner.

9. An exhaust gas cleaning device according to claim 1, wherein:

said burner is provided for regenerative operation in the operational pauses of the diesel engine after several diesel engine operating hours.

10. An exhaust gas cleaning device according to claim 1, further comprising:

control means of said burner for, at the beginning of the regenerative operation, turning on said combustion air fan and a glow plug, turning on a fuel pump of said burner in a time-delayed manner, turning off said glow plug after ignition of said burner and, after a certain time, turning off said fuel pump and allows said combustion air fan to stay in operation for a short or a longer period of time.

11. An exhaust gas cleaning device according to claim 1, wherein:

the burner is designed bring the filter body to a regeneration temperature of more than 550° C.

12. An exhaust gas cleaning device according to claim 1, wherein:

a sensor is provided which detects the amount of soot clogging the filter body and delivers a regeneration signal and/or triggers regeneration.

13. An exhaust gas cleaning device according to claim 1, wherein:

said second support wall defines openings for passage of a portion of said heated gas.

14. An exhaust gas cleaning device for diesel engines, comprising:

a filter housing including an intake side connected to a diesel engine exhaust line and an exhaust gas exit connection side;

a burner and combustion air fan assembly connected to said housing and including a heated gas connection providing heated gas to said housing intake side;

a soot filter formed of a material to be regenerated by soot combustion, said soot filter being positioned within said filter housing between said diesel engine exhaust intake side and said exit connection side;

an intermediate carrier surrounding a portion of said soot filter body to define exhaust entry side, said intermediate carrier facing said diesel engine exhaust line and facing said exhaust gas exit connection, said intermediate carrier being formed of a material to facilitate heat transfer between an outer side of said intermediate carrier and an outer surface of said soot filter, adjacent said intermediate carrier;

means defining a resonance space between said housing and said intermediate carrier including first and second support wall means supporting said intermediate carrier and said soot filter with respect to said housing, said first support wall means being upstream of said second support wall means, hot gas passage means for providing passage of heated gasses through one of said second wall means and said first wall means and over said intermediate carrier for heat transfer to said outer surface of said soot filter body for regeneration of said soot filter body during operation of said burner and for absorbing acoustical energy of said heated gas in said resonance space.

15. An exhaust gas cleaning device according to claim 14, further comprising:

another hot gas passage means for providing a passage of said heated gas through said first support wall means and over said intermediate carrier for heat transfer from said heated gases to said soot filter.

16. A method for cleaning exhaust gas of diesel engines, the method comprising the steps of:

providing a filter;

passing the exhaust gas through said filter to remove pollutants from the exhaust gas and trap the pollutants in said filter;

heating the exhaust gas to a temperature hot enough to burn off said pollutants trapped in said filter, after said filter has trapped a predetermined amount of pollutants;

heating an outside surface of said filter by bringing said heated exhaust gas into thermal contact with said outside surface of said filter; and attenuating acoustical energy of the exhaust gas by providing a resonance chamber around said filter and for containing said heated exhaust gas in thermal contact with said outside surface of said filter.

17. An exhaust gas cleaning device according to claim 14, wherein said means defining a resonance space has an axial dimension shorter than an axial dimension of said soot filter and intermediate carrier, said first support wall means being disposed spaced from an upstream end of said soot filter and intermediate carrier to define an annular heat transfer region around said soot filter and intermediate carrier, said second support wall means being positioned upstream of a downstream end of said soot filter and intermediate carrier to define an annular heat transfer space around a downstream end of said soot filter and intermediate carrier.

18. An exhaust gas cleaning device according to claim 15, wherein one of said hot gas passage means and said another hot gas passage means is of reduced cross section to provide flow resistance for minimizing exhaust gas flow through said means defining a resonance space.

* * * * *